US010774448B2

(12) United States Patent
Yang

(10) Patent No.: US 10,774,448 B2
(45) Date of Patent: Sep. 15, 2020

(54) METHOD OF MANUFACTURING A FABRIC

(71) Applicant: J.Y. Rays, Inc., South El Monte, CA (US)

(72) Inventor: Sam Yang, South El Monte, CA (US)

( * ) Notice: Subject to any disclaimer, the term of this patent is extended or adjusted under 35 U.S.C. 154(b) by 295 days.

(21) Appl. No.: 16/045,421

(22) Filed: Jul. 25, 2018

(65) Prior Publication Data

US 2019/0032249 A1 Jan. 31, 2019

Related U.S. Application Data

(60) Provisional application No. 62/537,396, filed on Jul. 26, 2017.

(51) Int. Cl.

| | |
|---|---|
| ***D01F 1/10*** | (2006.01) |
| ***D06C 27/00*** | (2006.01) |
| ***D06B 15/00*** | (2006.01) |
| ***D06C 7/02*** | (2006.01) |
| ***D03D 23/00*** | (2006.01) |
| ***D06B 1/00*** | (2006.01) |
| *D06M 101/32* | (2006.01) |
| *D06C 21/00* | (2006.01) |

(52) U.S. Cl.

CPC ..... *D01F 1/10* (2013.01); *D06B 1/00* (2013.01); *D06B 15/00* (2013.01); *D06C 27/00* (2013.01); *D03D 23/00* (2013.01); *D06C 7/02* (2013.01); *D06C 21/00* (2013.01); *D06M 2101/32* (2013.01); *D10B 2331/04* (2013.01); *D10B 2331/10* (2013.01)

(58) Field of Classification Search

CPC .... D03D 15/0016; D03D 23/00; D03D 15/00; D06C 7/02; D06C 21/00; D06C 27/00; D06C 29/00; D01F 1/10; D01F 6/62; D06B 1/00; D06B 15/00; D06M 2101/32; D10B 2331/10; D10B 2331/04

USPC ..... 28/167, 169, 165

See application file for complete search history.

(56) References Cited

U.S. PATENT DOCUMENTS

| | | | | |
|---|---|---|---|---|
| 3,227,511 | A * | 1/1966 | Seltzer | D03D 15/08 8/183 |
| 3,899,810 | A * | 8/1975 | Stanley | D03J 1/00 28/166 |
| 6,062,272 | A * | 5/2000 | Waite | D03D 15/00 139/420 A |
| 6,342,456 | B1 * | 1/2002 | Jenkins | D03D 15/00 139/383 R |
| 2006/0009103 | A1 * | 1/2006 | Chen | D03D 15/00 442/79 |
| 2007/0087162 | A1 * | 4/2007 | Mandawewala | D02G 3/44 428/97 |
| 2008/0057813 | A1 * | 3/2008 | Tingle | D03D 15/00 442/203 |

(Continued)

*Primary Examiner* — Amy Vanatta

(74) *Attorney, Agent, or Firm* — Tommy S F Wang; Wang IP Law Group, P.C.

(57) ABSTRACT

The present application discloses a method of manufacturing a fabric. The method comprises warping a yarn; sizing the yarn with a strengthening agent; weaving the yarn; greying the yarn to form a prototype of the fabric; desizing the strengthening agent; adding a quick-drying agent on the prototype; and drying the prototype to form the fabric. In addition, before or after adding a quick-drying agent on the prototype, the method further comprises adding an anti-bacterial agent or an anti-ultraviolet agent on the prototype.

10 Claims, 2 Drawing Sheets

(56) References Cited

U.S. PATENT DOCUMENTS

| | | | | |
|---|---|---|---|---|
| 2017/0198432 | A1* | 7/2017 | Richards | D06N 3/009 |
| 2019/0177894 | A1* | 6/2019 | Ballone | D06M 11/40 |
| 2020/0040490 | A1* | 2/2020 | Jain | D01D 5/11 |
| 2020/0056309 | A1* | 2/2020 | Gupta | D03D 15/00 |

* cited by examiner

METHOD OF MANUFACTURING A FABRIC

CROSS-REFERENCE TO RELATED APPLICATION

This application claims the priority of provisional patent application U.S. Ser. No. 62/537,396 filed Jul. 26, 2017 which is expressly incorporated by reference herein in its entirety.

TECHNICAL FIELD OF THE INVENTION

The present application generally relates to fabrics, and more particularly, to a method of manufacturing a fabric.

BACKGROUND OF THE INVENTION

Generally, manufacturers manufacture surfing suits by utilizing quick-drying fabrics. In addition, anti-bacterial or anti-ultraviolet function is usually achieved by laminating or coating additional layers. However, users still need to wait for those fabrics becoming dry and it generally takes time since the quickness of drying is limited. The costs for manufacturing process is also high since the additional machine is required for lamination or coating.

Furthermore, the manufactures generally won't utilize the fabrics of the surfing suits for land-used garments since the breathability of the wet fabrics of surfing suits is worse compared to the common land-used garments, making the user feel uncomfortable because of low breathability after sweating.

Therefore, a need remains for a method of manufacturing a fabric to provide an improved, low cost and amphibious fabric.

SUMMARY OF THE INVENTION

The present application discloses method of manufacturing a fabric to provide an improved, low cost and amphibious fabric.

The method of manufacturing a fabric comprises warping a yarn; sizing the yarn with a strengthening agent; weaving the yarn; greying the yarn to form a prototype of the fabric; desizing the strengthening agent; adding a quick-drying agent on the prototype; and drying the prototype to form the fabric.

In various exemplary embodiments, before or after adding a quick-drying agent on the prototype, the method further comprises adding an anti-bacterial agent on the prototype.

In various exemplary embodiments, before or after adding a quick-drying agent on the prototype, the method further comprises adding an anti-ultraviolet agent on the prototype.

In various exemplary embodiments, after desizing the strengthening agent, the method further comprises bleaching the prototype; dyeing the prototype; and washing the prototype.

In various exemplary embodiments, before drying the prototype to form the fabric, the method further comprises sanforizing the prototype. The prototype is sanforized by performing a resin finishing process to the prototype.

In various exemplary embodiments, after drying the prototype to form the fabric, the method further comprises setting the fabric.

In various exemplary embodiments, the fabric is a jacquard fabric.

Based on the above, the present application allows users to have the fabric with a better quick-drying performance by selecting a different raw material for fabric rather than the raw material with quick-drying property, and then adding the quick-drying agent during the manufacturing process. In addition, the cost may also be lowered down since the laminating or coating machine are not further required because of the anti-bacterial agent and the anti-ultraviolet agent. Meanwhile, since the breathability of the fabric of the present application is suitable for both in and out of water due to the different selection of the raw material for the fabric, the user can wear the garment made by the fabric amphibiously.

Numerous other advantages and features of the present application will become readily apparent from the following detailed description of disclosed embodiments, from the claims and from the accompanying drawings.

BRIEF DESCRIPTION OF THE DRAWINGS

The objects, features and advantages of the present application will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF DISCLOSED EMBODIMENTS

Figure 1:
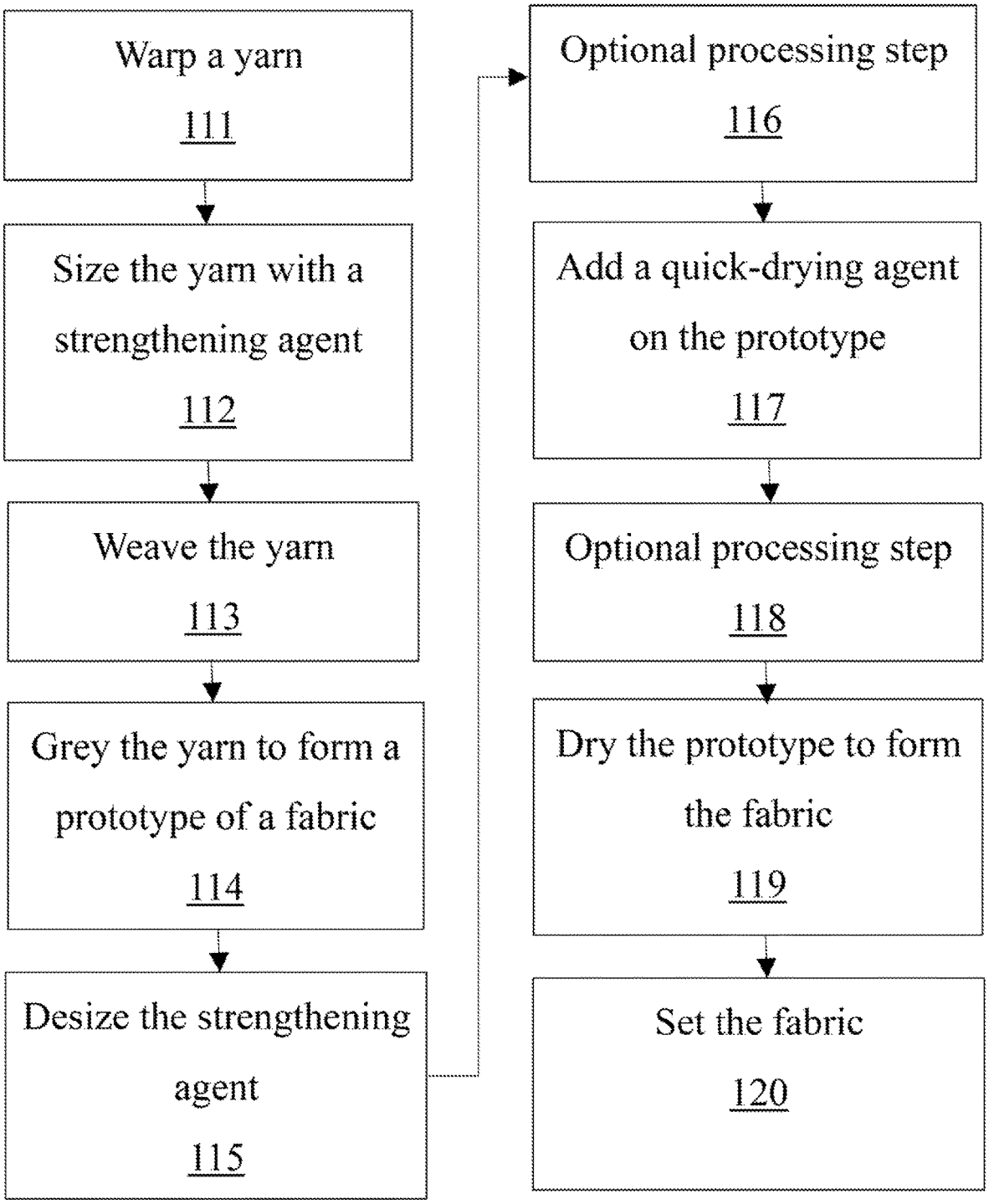
FIG. 1 is a flow chart of a method of manufacturing a fabric.

Reference will now be made in detail to the present representative embodiments of the present application, examples of which are illustrated in the accompanying drawings. Wherever possible, the same reference numbers are used in the drawings and the description to refer to the same or like parts.

FIG. 1 is a flow chart of a method of manufacturing a fabric.

As shown in step 111, warping a yarn in a warp beam evenly. Specifically, every section of the yarn wrapped about the warp beam should keep tensions as the same, making wear be reduced and further maintaining its physical and mechanical properties. The present application can utilize any kind of yarn for manufacturing the fabric and is not limited.

Referring to step 112, Sizing the yarn with a strengthening agent after warping the yarn. By doing so, fibers of the yarn may be attached to each other. Therefore, the endurance of the yarn is increased for sustaining the repetitive abrasion, stretch or bend during the following process, reducing the possibility of striking out or rupture.

After sizing the yarn then weaving the yarn as shown in step 113. It should be noted that the type of weaving is not limited in the present application. The fabric can be woven by weft knitting, warp knitting, flat knitting or the combination thereof. In addition, the fabric also may be woven manually or by a machine, the present application is not limited either. Then, a prototype of the fabric is formed after greying the yarn as shown in step 114.

Referring to step 115, desizing the strengthening agent after greying the yarn. Specifically, removing the remaining strengthening agent to reduce its influence on the wettability during the following process. In addition, the impurities in the fibers also can be removed in the step 115.

Afterward, optional processing steps 116 and 118 may be proceeded. The optional steps 116 and 18 will be described later with reference to FIG. 2.

Between the optional steps 116, the method further comprises adding a quick-drying agent on the prototype as shown in step 117. Therefore, the present application can achieve the purpose of having better quick-drying performance without utilizing the raw material with quick-drying property for the fabric since the drying speed of such raw material still has its limitation. In addition, the breathability also can also be increased since the breathability of such raw material is generally worse.

As shown in step 119, drying the prototype to form the fabric after the optional step 118. Specifically, heating the prototype in a predetermined time with the fibers maintain in a predetermined tension. Therefore, the fabric may be flat after drying.

Next, setting the fabric as shown in step 120 for selling in the market. It should be noted that the step 120 may comprise cutting the fabric or any other steps that make the fabric to be a wearable piece such as garment or pants. The present application is not limited thereto. In addition, the fabric in the present application can be any kind of fabric such as jacquard, dobby, acrylic, ribstop, satin, sateen, pongee, poplin, bengaline, crinkle, flannel, muslin, oxford, quilted textile, suiting, taffeta, taslon etc. as long as the fabric is manufactured by the abovementioned steps. The present application is not limited; the yarn here is a jacquard yarn and the fabric here is therefore jacquard fabric as an example.

Figure 2:
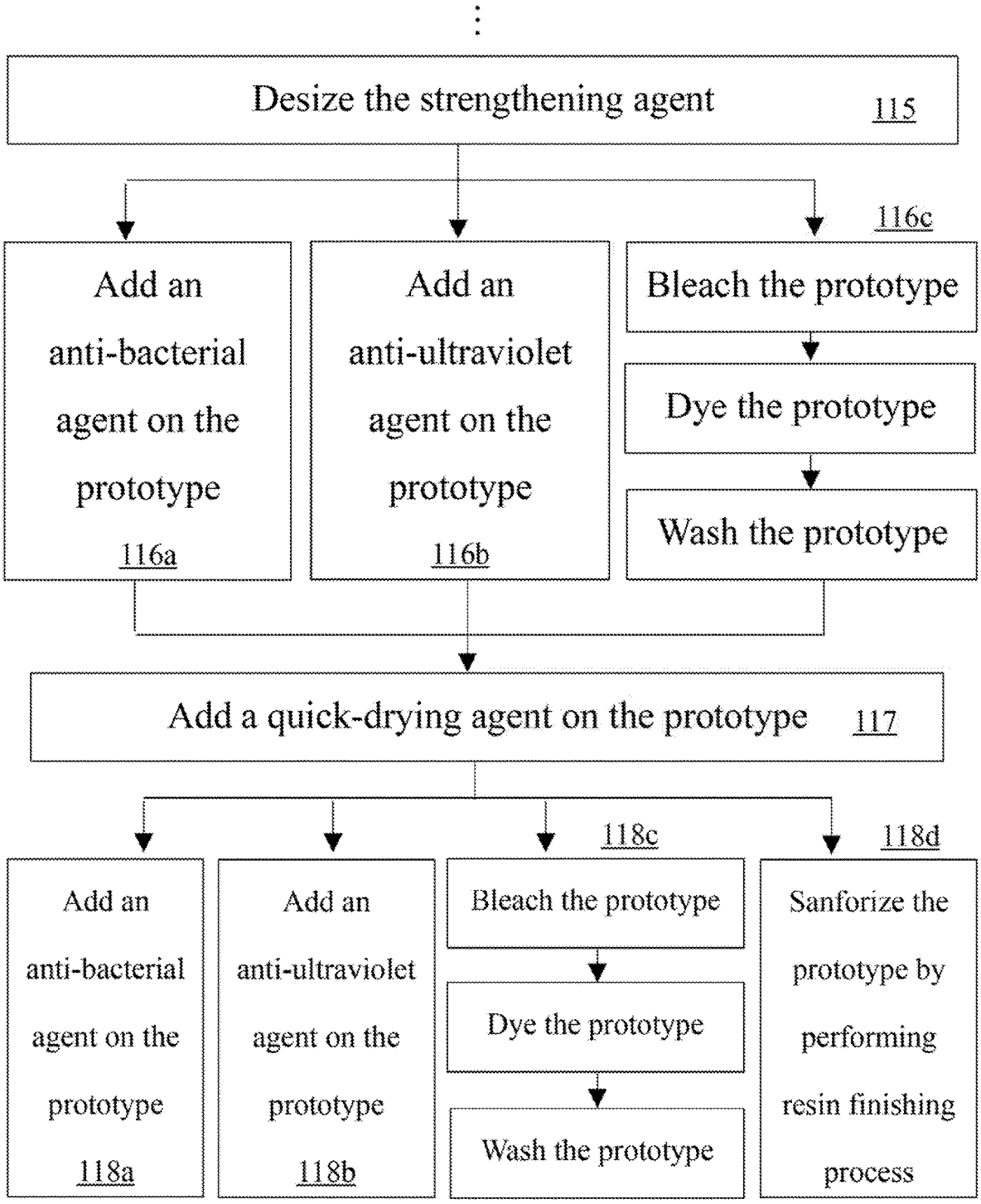
FIG. 2 is a flow chart for optional processing steps in FIG. 1.

FIG. 2 is a flow chart for optional processing steps in FIG. 1.

Referring to FIG. 2, as shown in steps 116*a*, 116*b* and 116*c*, the optional step 116 (referring to FIG. 1) comprises adding an anti-bacterial agent on the prototype, adding an anti-ultraviolet agent on the prototype, and coloring the fabric. In addition, the optional step 118 (referring to FIG. 1) comprises adding an anti-bacterial agent on the prototype, adding an anti-ultraviolet agent on the prototype, coloring the fabric and sanforizing the prototype as shown in steps 118*a*, 118*b*, 118*c* and 118*d*.

Specifically, the quick-drying agent, anti-bacterial agent and the anti-ultraviolet agent can be added on the prototype by any order and is not limited.

The coloring step comprises bleaching the prototype, dyeing the prototype and washing the prototype. In detail, the bleaching step is required since the natural pigment of the fibers may still be existed, making the appearance be less even. After that, dyeing the prototype by in a predetermined temperature and time for fixing the needed pigment in the prototype. Then stabilizing the needed pigment by washing the prototype.

As shown in step 118*d*, before drying the prototype to form the fabric as shown in step 119 (referring to FIG. 1), the method may comprise sanforizing the prototype by performing resin finishing process to the prototype. Therefore, the elasticity may be increased and further reduce wrinkles.

The fabric composition in the present application is 96% of polyester and 4% of elastane. The weight is about 175 g/m. By the above composition, the fabric of the present application can have better flexibility, being retracted to its original state after being pulled. However, the present application is not limited thereto, the composition of the fabric can be modified as long as it can reach the above-mentioned functionalities such as wicking, anti-abrasion, anti-bacterial, UV-protection or soft hand-feeling etc.

Based on the above, the present application allows users to have the fabric with a better quick-drying performance by selecting a different raw material for fabric rather than the raw material with quick-drying property, and then adding the quick-drying agent during the manufacturing process. In addition, the cost may also be lowered down since the laminating or coating machine are not further required because of the anti-bacterial agent and the anti-ultraviolet agent. Meanwhile, since the breathability of the fabric of the present application is suitable for both in and out of water due to the different selection of the raw material for the fabric, the user can wear the garment made by the fabric amphibiously.

It will be apparent to those skilled in the art that various modifications and variations can be made to the structure of the present application without departing from the scope or spirit of the present application. In view of the foregoing, it is intended that the present application cover modifications and variations of this application provided they fall within the scope of the following claims and their equivalents.

What is claimed is:

1. A method of manufacturing a fabric, comprising:
warping a yarn;
sizing the yarn with a strengthening agent;
weaving the yarn;
greying the yarn to form a prototype of the fabric;
desizing the strengthening agent;
adding a quick-drying agent on the prototype; and
drying the prototype to form the fabric.

2. The method of manufacturing a fabric as claimed in claim 1, wherein before or after adding a quick-drying agent on the prototype, the method further comprises adding an anti-bacterial agent on the prototype.

3. The method of manufacturing a fabric as claimed in claim 1, wherein before or after adding a quick-drying agent on the prototype, the method further comprises adding an anti-ultraviolet agent on the prototype.

4. The method of manufacturing a fabric as claimed in claim 1, wherein after desizing the strengthening agent, the method further comprises bleaching the prototype.

5. The method of manufacturing a fabric as claimed in claim 4, wherein after bleaching the prototype, the method further comprises dyeing the prototype.

6. The method of manufacturing a fabric as claimed in claim 5, wherein after dyeing the prototype, the method further comprises washing the prototype.

7. The method of manufacturing a fabric as claimed in claim 1, wherein before drying the prototype to form the fabric, the method further comprises sanforizing the prototype.

8. The method of manufacturing a fabric as claimed in claim 7, wherein the prototype is sanforized by performing a resin finishing process to the prototype.

9. The method of manufacturing a fabric as claimed in claim 1, wherein after drying the prototype to form the fabric, the method further comprises setting the fabric.

10. The method of manufacturing a fabric as claimed in claim 1, wherein the fabric is a jacquard fabric.

* * * * *